US012186617B2

(12) United States Patent
Watry et al.

(10) Patent No.: US 12,186,617 B2
(45) Date of Patent: Jan. 7, 2025

(54) GYM HANDLE

(71) Applicant: Dynepic Sports, LLC, Sherwood, OR (US)

(72) Inventors: Krissa Elizabeth Watry, Reno, NV (US); Benjamin Schroeder, Huntington Beach, CA (US)

(73) Assignee: Dynepic Sports, LLC, Sherwood, OR (US)

( * ) Notice: Subject to any disclaimer, the term of this patent is extended or adjusted under 35 U.S.C. 154(b) by 168 days.

(21) Appl. No.: 17/737,531

(22) Filed: May 5, 2022

(65) Prior Publication Data

US 2023/0356022 A1 Nov. 9, 2023

(51) Int. Cl.
*A63B 21/00* (2006.01)

(52) U.S. Cl.
CPC ..... *A63B 21/4035* (2015.10)

(58) Field of Classification Search
CPC ..... A63B 21/4035; A63B 21/062–0632
See application file for complete search history.

(56) References Cited

U.S. PATENT DOCUMENTS 3,517,931 A * 6/1970 Barton ..... A63B 5/20 482/82
4,375,886 A * 3/1983 Muys ..... A63B 5/20 482/82
4,784,391 A * 11/1988 Herron ..... A63B 67/10 473/576
5,984,845 A * 11/1999 Powers ..... A63B 23/00 482/148
6,450,929 B1 * 9/2002 Markham ..... A63B 21/1645 482/904
7,691,040 B1 * 4/2010 Schwinghamer ..... A63B 21/00 482/106
9,011,304 B2 * 4/2015 Gilman ..... A63B 21/00 482/139
9,370,685 B2 6/2016 Watry
D782,272 S 3/2017 Watry
9,757,604 B2 * 9/2017 Carter ..... A63B 5/20
10,118,084 B2 11/2018 Watry
10,286,251 B2 5/2019 Watry
2002/0065175 A1 * 5/2002 Walker ..... A63H 1/32 482/110
2004/0009858 A1 * 1/2004 Tamaribuchi ..... A63B 21/4017 482/121

(Continued)

*Primary Examiner* — Nyca T Nguyen
(74) *Attorney, Agent, or Firm* — Shumaker, Loop & Kendrick, LLP; Patrick B. Horne

(57) ABSTRACT

A handle assembly for coupling to exercise equipment such as resistance bands or weights. The handle assembly includes a grip handle having a conical elastomeric grip with a central opening, where the elastomeric grip is defined by an increasing outer surface circumference along its length to form a conical shape for the user to grasp. The conical grip handle is designed to fit the natural anatomical shape of the user's hand when grasping. A tubular bar may be fitted inside the central opening of the grip handle. A tensile member passes through the grip handle and forms a loop outside the grip handle, where the tensile member is connected to the exercise equipment via a ring, quick link or pulley. End caps may be fitted into the ends of the tubular bar, having openings which allow the tensile member ends to pass through into the interior of the bar.

34 Claims, 9 Drawing Sheets

(56) References Cited

U.S. PATENT DOCUMENTS

| | | | | |
|---|---|---|---|---|
| 2006/0027189 | A1* | 2/2006 | Luber | A01K 27/003 119/795 |
| 2008/0040891 | A1* | 2/2008 | Tyler | A63B 21/4017 16/421 |
| 2010/0248907 | A1* | 9/2010 | Kessler | A63B 5/20 482/82 |
| 2011/0245050 | A1* | 10/2011 | Emick | A63B 21/4035 482/139 |
| 2015/0005144 | A1* | 1/2015 | Abdella | A63B 21/0552 482/129 |
| 2015/0024908 | A1* | 1/2015 | Hall | A63B 21/0722 482/93 |
| 2016/0346589 | A1* | 12/2016 | Emick | A63B 21/0628 |
| 2018/0250544 | A1* | 9/2018 | Hur | A63B 21/4003 |
| 2021/0260436 | A1* | 8/2021 | McCrea | A63B 21/0552 |
| 2022/0152441 | A1* | 5/2022 | Karnes, Jr. | A63B 21/00043 |
| 2022/0395716 | A1* | 12/2022 | Leipheimer | A63B 21/4019 |

* cited by examiner

GYM HANDLE

BACKGROUND

Field

The present disclosure relates generally to an ergonomic handle for transferring a force, such as to use with exercise equipment in a gym. More particularly, the disclosure relates to a gym handle with a conical grip designed to comfortably fit the natural anatomical shape of a human hand grasping the handle, where the handle features a grip having a conical shape and size designed for optimal hand fit and load transfer, and an integrated rope or strap for connection to load-bearing exercise equipment. Designs featuring a tubular bar fitted in a central opening of the conical grip are also disclosed.

Discussion of the Related Art

Hand grips are used with varying degrees of comfort in the operation of a variety of devices, including grips for using exercise equipment. One known type of hand grip, a two-handed grip 100 used on an exercise machine as shown in FIG. 1, is uncomfortable. The grip 100 comprises a tricep rope 102 with two grip stops 104, one at each end. The rope 102 is held by a hollow tubular bracket 106 that includes a hole which attaches to a cable pull exercise machine via a cable 110, where the rope 102 is passed through the tubular bracket 106. This design requires the user to maintain a firm grip on the rope 102 to reduce the load incurred by the stops 104 on the hand. During a weighted exercise, the grip stops 104 apply load through the pinky finger and outside base of the palm for a tricep push-down style exercise or the index finger and thumb during a hammer curl style exercise. Since the user's grip typically cannot bear the entire load, the small surface area of the hand against the grip stop 104 bears the load and makes gripping uncomfortable for the user, especially as the weight used during the exercise is increased.

An additional problem with the grips shown in FIG. 1 is that the rope 102 has peaks and valleys that may be helpful for the grip but catch on the hollow tube bracket as it slides through, resulting in uneven rope lengths which produce uneven weight distribution on the user's arms during the exercise. Another type of hand grip includes beaded grips to combat the discomfort. Other prior art grips use airline cable instead of a braided or twisted rope and have the user grip a shaped handle in the form of a half sphere or a T-shape. However these grips require the flexible airline cable to be threaded through the user's fingers as the user grips the shape, which ultimately reduces the range of motion as the airline cable applies pressure to the inside webbing between the fingers.

Another known grip design is the single-hand grip 200 shown in FIG. 2. The grip 200 uses a more conventional handle where a flexible member 202 is attached to both end of the handle grip, and the flexible member 202 is in turn attached to a cable pull exercise machine via a cable 210. The grip 200 has a cylindrical grip tube, typically with larger diameter grip guards on both ends of the tube to protect the user's hand from the flexible member 202 during some types of motion. The grip guards also serve as load bearing surfaces to assist in transferring load from the user's hand, because the cylindrical grip tube is difficult to grasp tightly enough to transfer loads along the direction of the grip tube, as illustrated in FIG. 2.

The prior art grips described above all suffer from significant limitations. First, the simple cylindrical shape of the grip surface is not designed to match the anatomical shape of the human hand when grasping in a normal fashion, and does not effectively distribute load across the surface of the user's hand. This can make conventional grips uncomfortable to use for various load directions, leading to hand fatigue. In addition, the simple cylindrical shape of the grip surface does not assist in transferring load from the user's hand along the length of the grip handle. This fact has led to the addition of the grip stops and grip guards discussed above; however, the resulting concentrated load on one end of the hand—such as the outer surface of the pinky finger—is also uncomfortable and inefficient.

In view of the circumstances described above, there is a need for an improved handle for use with exercise equipment, especially the type of equipment where a tensile load is borne by a single hand.

SUMMARY

The present disclosure describes a handle assembly for coupling to exercise equipment such as resistance bands or weights. The handle assembly includes a grip handle having a conical elastomeric grip element fitted over a tubular bar, where the grip element is defined by an increasing outer surface circumference along its length to form a conical shape for the user to grasp. The conical grip handle is designed to fit the natural anatomical shape of the user's hand when grasping. The grip element is constructed of an elastomeric material that is slightly compressible while maintaining its shape, and which may have a slightly tacky surface feel.

A rope has both ends secured inside the tubular bar such that the rope forms a loop outside the grip handle, where the rope is connected to the exercise equipment via a quick link, ring or pulley. End caps fitted into the ends of the tubular bar have openings which allow the rope ends to pass through into the interior of the bar, and the openings have smooth curved inside surfaces to prevent chafing of the rope. The end caps may be threaded, press-fit or glued into the ends of the tubular bar. The ends of the rope are either knotted or crimped together inside the tubular bar, or the ends are each knotted separately to ensure the rope ends remain inside the bar. A strap may be provided rather than a rope, and a design without the tubular bar in the central opening of the conical grip is disclosed.

The generally cone-shaped grip provides a comfortable and ergonomic surface to securely distribute the user's grasp force during the exercise movements, thus significantly reducing the pressure points and grip effort compared to current exercise handles and thus allowing a relaxed hand grip.

Additional features of the present disclosure will become apparent from the following description and appended claims, taken in conjunction with the accompanying drawings.

DETAILED DESCRIPTION OF THE EMBODIMENTS

The following discussion of the embodiments of the disclosure directed to a gym handle with a conical grip is merely exemplary in nature, and is in no way intended to limit the disclosure or its applications or uses.

Figure 1:
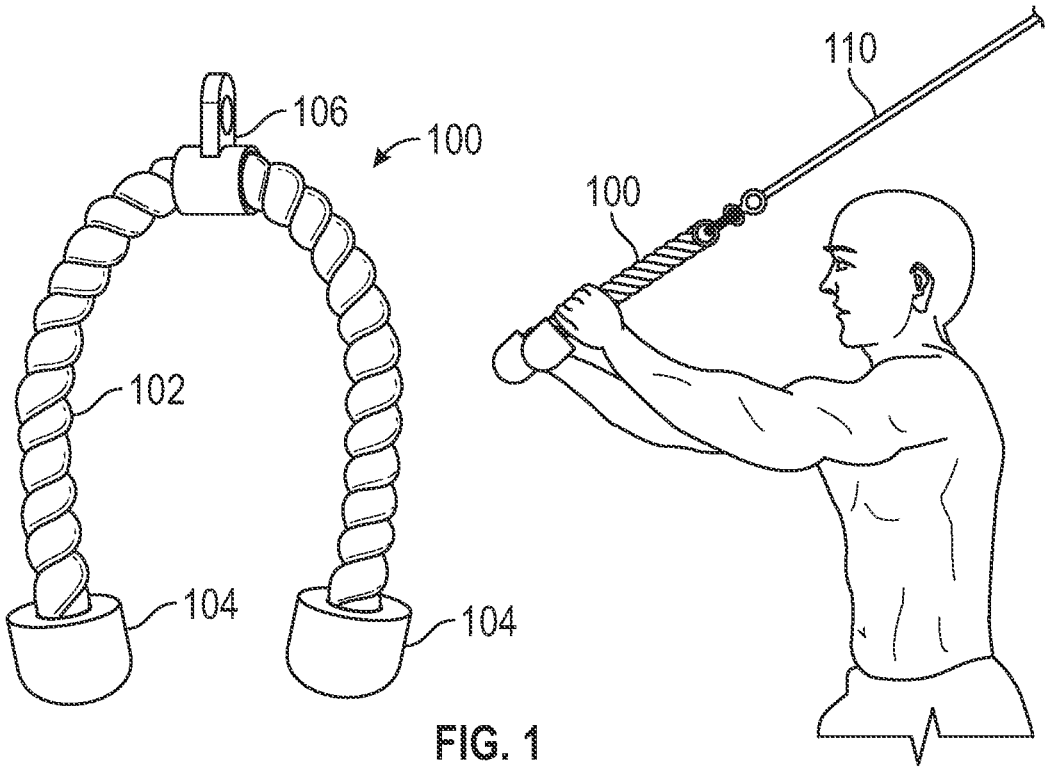
FIG. 1 (Prior Art)
FIG. 1 is an illustration of a two-hand rope-style exercise grip with grip stops, as known in the art.
Figure 2:
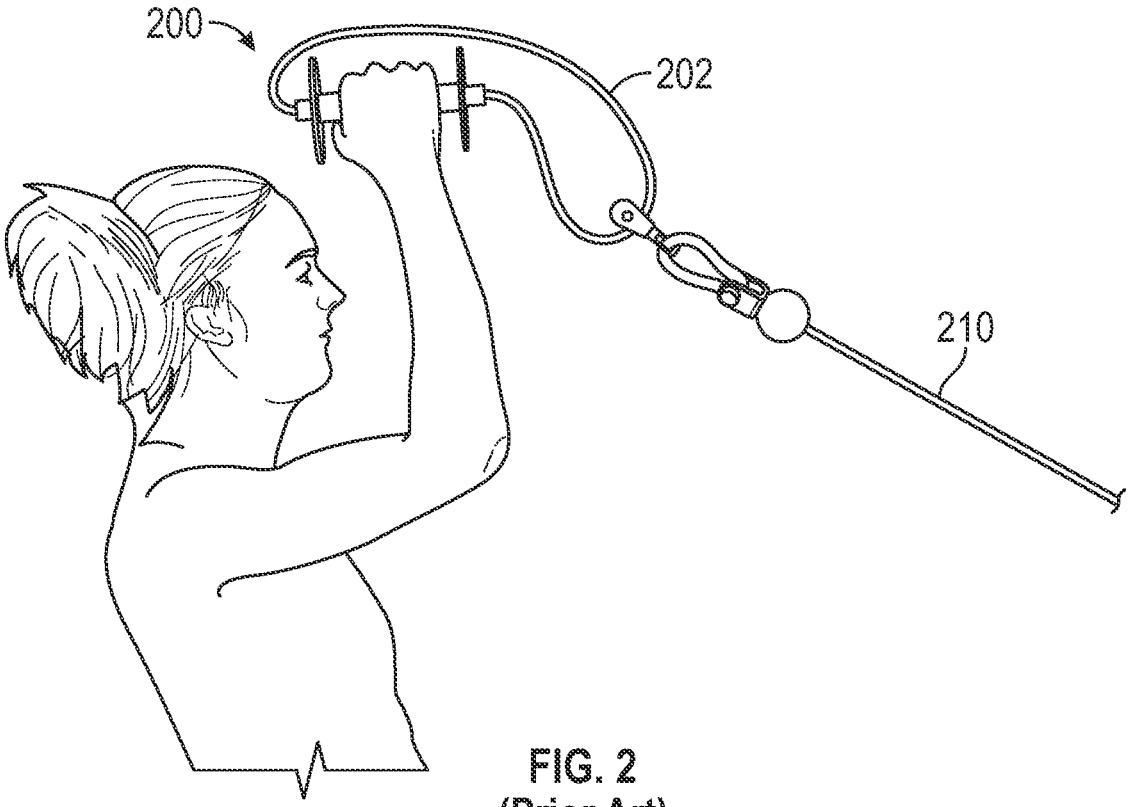
FIG. 2 (Prior Art)
FIG. 2 is an illustration of a single-hand exercise grip with a cylindrical grip and grip guards, as known in the art.

Exercise grips and grip handles have traditionally been designed with a simple cylindrical shape which is not anatomically suited to a user's grasp, and which does not offer any assistance in bearing an axial load along the grip. As a result, grips such as those shown in FIGS. 1-2 and discussed above use grip stops and grip guards to prevent the user's hand from slipping off an end of the grip. These grip stops and grip guards create uncomfortable pressure points on the user's hand in some circumstances. In addition, these existing grip handles can cause hand fatigue due to the mismatch between the shape of the grip surface and the natural shape of the user's grasp.

The gym handle of the present disclosure is designed to overcome the shortcomings and limitations of current grips and grip handles. The disclosed gym handle features a conical grip shape which is designed to match the natural anatomical shape of the user's grasp. This conical shape reduces hand fatigue, and also enables the user to apply an axial force along the length of the grip without requiring excessive squeezing effort.

Figure 3:
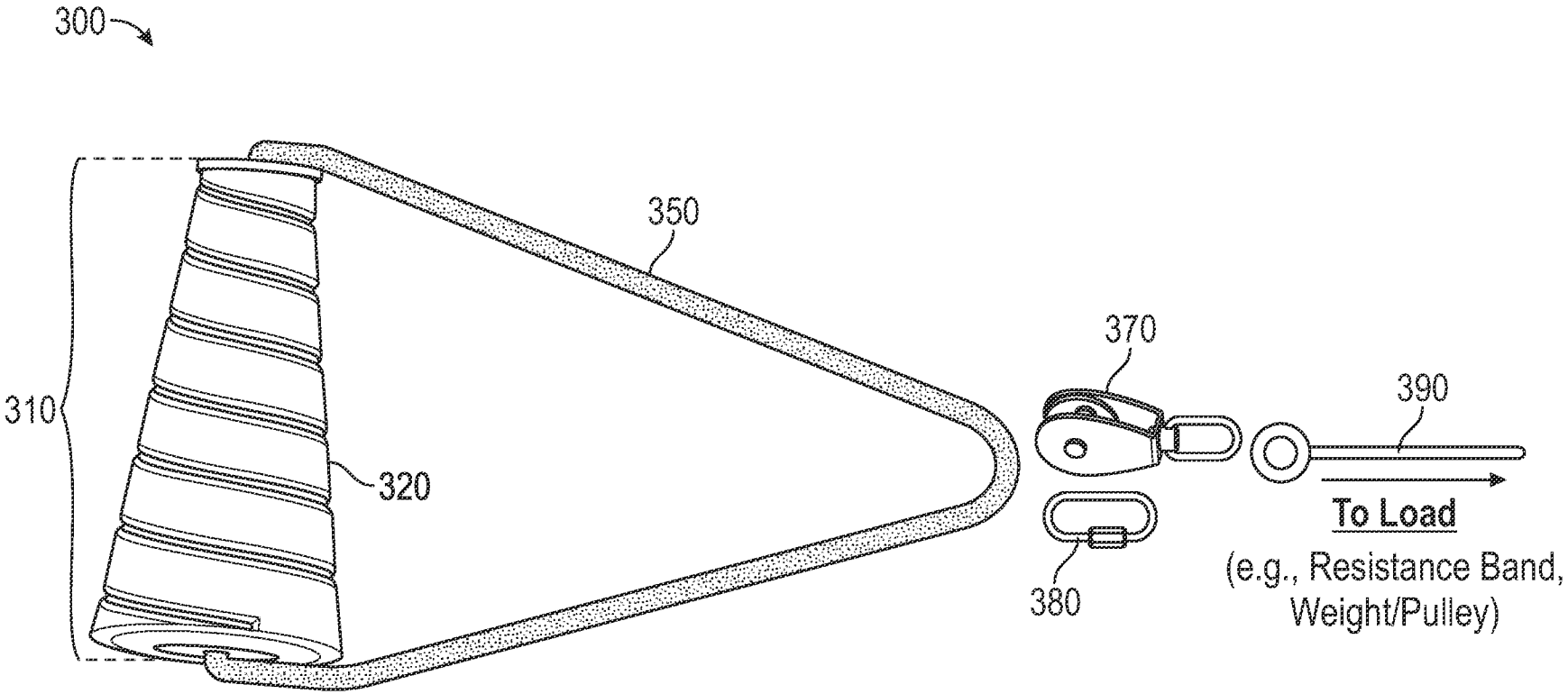
FIG. 3 is an illustration of a gym handle including a grip assembly having a conical grip element, and a rope passing through the grip assembly and forming a closed loop, according to an embodiment of the present disclosure.

FIG. 3 is an illustration of a gym handle 300 including a grip assembly 310 having a conical grip element 320, and a rope 350 forming a closed loop with rope ends secured inside the grip assembly 310, according to an embodiment of the present disclosure. The rope 350 is, in fact, a rope in a preferred embodiment. However, the rope 350 may be some other suitable material, which is very flexible, strong and generally inelastic in tension.

A coupling device—such as an eye loop pulley 370, a quick connect link 380, a carabiner (not shown), a ring (not shown) or an eye-to-eye swivel (not shown)—connects the gym handle 300 to a tensile member 390 of an exercise equipment apparatus (not shown). The tensile member 390 may be, for example, a resistance band with a distal end fixed to a structure, or a cable which passes over a pulley arrangement to raise and lower weights. An eye-to-eye swivel coupling device allows the gym handle to spin or rotate when attached to an exercise apparatus. This is helpful to orient the grips, especially when two gym handles can be attached to the same exercise apparatus for bilateral (two hand) movements.

The gym handle 300, and particularly the conical grip element 320, provide significant advantages over prior art grip handles. The conical shape of the grip element 320 matches the natural anatomical shape of the hand of a user grasping the grip element 320. That is, the thumb and forefinger of the user's hand form an approximate circle around the smaller diameter end of the grip element 320 (at the top as shown in FIG. 3), while the other fingers of the users hand wrap around the increasing diameter portions of the conical grip element 320, without being forced into an unnatural cylindrical shape as required of prior art grip handles. The conical grip element 320 also spreads the grip force over a larger surface area of the user's hand than traditional cylindrical grip handles.

In addition, the conical shape of the grip element 320 serves as a wedge which allows the user's hand to apply an axial force (from the smaller diameter end toward the larger diameter end) without having to rely solely on grip pressure (hand squeezing force) and friction. In some exercise movements, such as where the user pulls the gym handle 300 towards himself/herself and down (to the left and down in FIG. 3), the hand bearing against the increasing diameter of the cone assists with the pulling effort applied to the tensile member 390.

The conical grip element 320 is preferably constructed of an elastomeric material which offers some compliance or flexibility when grasped by the user, and may be slightly tacky to the touch. The slight compressibility of the conical grip element 320 adds to the grip comfort for the user, however the hardness is such that it does not deform in shape or bend. The proper selection of material aids in a more secure relaxed grasp. Materials are discussed further below.

The outer surface of the conical grip element 320 may be smooth, or the surface may have any of a variety of shapes or patterns formed into or upon it. In one preferred embodiment, a spiral groove is formed into the surface of the conical grip element 320, where the spiral groove extends continuously from one end of the grip element 320, around the surface in a conic helical shape, to the other end of the grip element 320. This embodiment is shown in FIG. 3 and later figures. The spiral groove in the outer surface of the conical grip element 320 serves as a structural feature which increases grip stability for the user's grasp, and can also serve to channel liquid (e.g., perspiration) away from the user's hand. Other indented shapes/patterns or raised shapes/patterns may be applied to the surface of the grip element 320 as deemed suitable.

The gym handle 300 of the present disclosure may be used with exercise equipment in many different ways. Exercises which may be performed using the gym handle 300 include curls, "lat" pulls, chest press, flies, rows, triceps pushdowns and overhead triceps extensions, and many others. In these exercises, the gym handle 300 may be pulled upward against the vertically-oriented tensile member 390, pulled or pushed downward against the vertically-oriented tensile member 390, pulled or pushed horizontally against the horizontally-oriented tensile member 390, or in any other direction or configuration.

Figure 4:
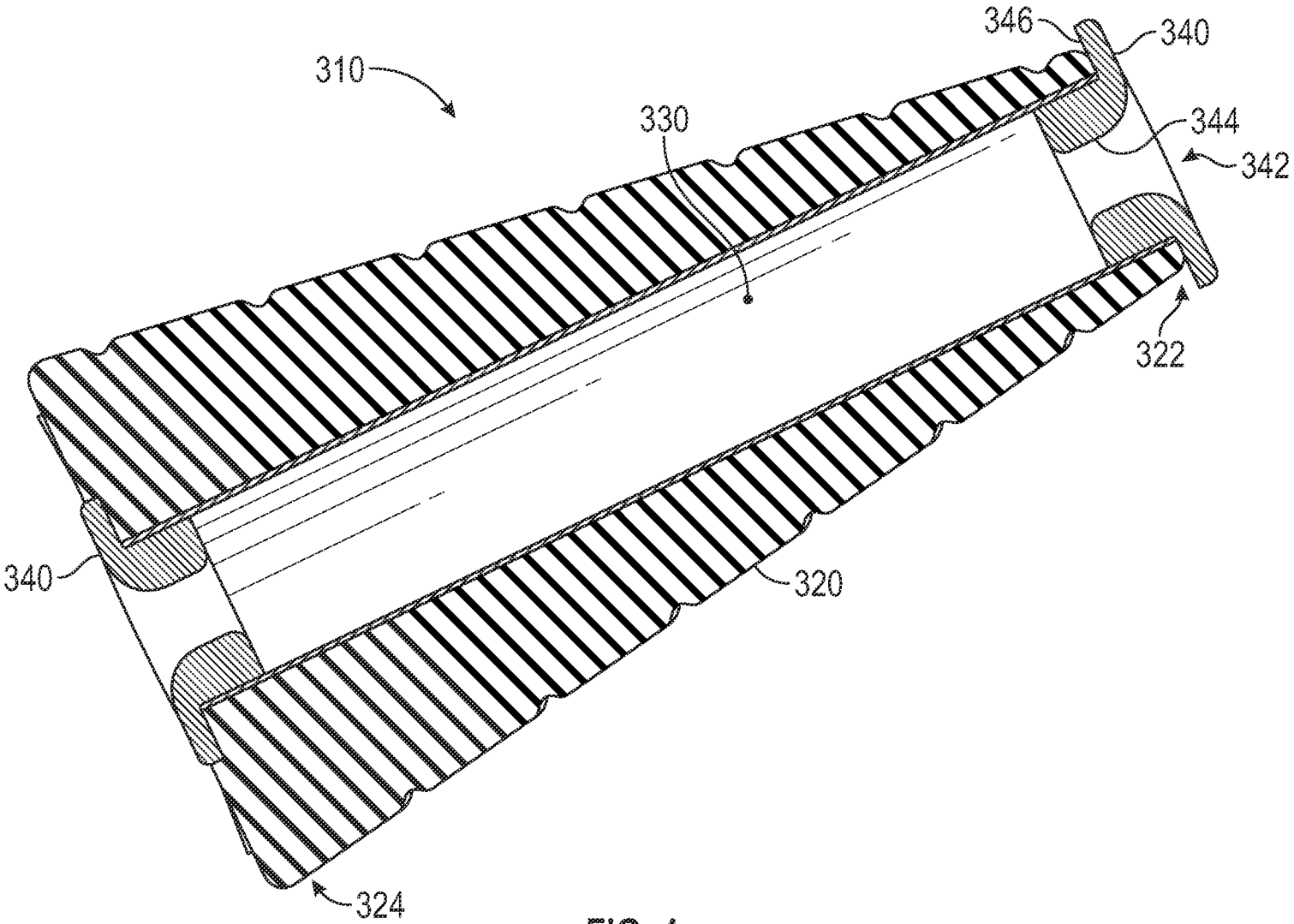
FIG. 4 is a cross-sectional illustration of the grip assembly of FIG. 3, including the conical grip element and also including a tubular bar with end caps fitted into the tubular bar at each end, according to an embodiment of the present disclosure.

FIG. 4 is a cross-sectional illustration of the grip assembly 310 of FIG. 3, including the conical grip element 320 and also including a tubular bar 330 with end caps 340 fitted into the tubular bar 330 at each end, according to an embodiment of the present disclosure.

The conical grip element 320 has a first end 322 with a smaller diameter, and a second end 324 with a larger diameter. Typically the diameter of the first end 322 is from about 0.75 inches to about 1.5 inches, preferably about 1.0 inch. The diameter of the second end 324 is greater than the diameter of the first end 322 by an amount that forms a cone angle in a range from 10° to 35°, preferably from 15° to 30°, most preferably about 18°. When the cone angle is below 10° the user does not receive the full benefit of the distribution of the resistance force across the user's hand, thus requiring more grip strength to hold onto the grip handle. When the cone angle is greater than about 35° the grip element 320 is uncomfortable to grasp and the grip force is unequally concentrated rather than distributing over the entire hand. A first end diameter of about 1.0 inch and a cone angle of about 18° has been determined to be an optimal shape and size for the vast majority of user's hands.

The length of the conical grip element 320 from the first end 322 to the second end 324 may vary somewhat but is generally from about 4.0 inches to about 6.5 inches, most preferably 4.75 inches. This length ensures that the gym handle 300 fits well for those users with smaller hands as they can grasp near the first end 322, while those with larger hands can have enough grip length to comfortably grasp as well.

Additionally, the outer surface of the conical grip element 320 may have a shape which is not a true straight-sided cone, but may have other similar designs with increasing circumference over the length of the grip. For example, the conical grip element 320 may have a circumference which increases continuously from the first end 322 to the second end 324, and an outer surface shape which is outwardly convex.

The conical grip element 320 is preferably constructed of a rubber-like material, for example, a viscoelastic, urethane or closed cell foam material. It is conceived that a wide range of materials with varying durometer hardness could be used for the conical grip element 320, ranging from very soft and compliant to very firm and minimally compliant. It is preferable that such materials have a hardness in the range between Shore 20-00 (very soft) and Shore 90A (very firm). Any elastomeric or similar material—including natural or synthetic rubbers, foams, cork, etc.—meeting this hardness range, and preferably being slightly tacky or sticky to the touch, may be used to make the conical grip element 320. A hardness of 65A-75A is the most preferable for the conical grip element 320.

The conical grip element 320 has the conical (or similar) outer surface shape as described above and shown in FIG. 4, and has a cylindrical hole passing centrally through from one end to the other. The tubular bar 330, which adds stiffness to ensure the grip doesn't flex or bend under load perpendicular to the grip axis, is positioned inside the cylindrical hole in the conical grip element 320. The conical grip element 320 may be over-molded directly on the tubular bar 330, or conical grip element 320 may be formed separately and subsequently installed on the tubular bar 330. The inner diameter of the cylindrical hole may be made the same or slightly smaller than the outer diameter of the tubular bar 330, so that the conical grip element 320 stretches and fits firmly in place when installed over the tubular bar 330. The conical grip element 320 may also be formed to be slightly longer than the length of the tubular bar 330, so that when the grip element 320 is pressed onto the bar 330, friction forces compress the grip element 320 to the same length as the bar 330. An embodiment without the tubular bar 330 is discussed later.

The end caps 340 are formed with an aperture 342 through which the rope 350 passes. Interior surfaces 344 of the aperture 342 are shaped with a smooth, convex surface so that the rope 350 may rub against the surfaces 344 without chafing the rope 350.

The end cap 340 on one end of the tubular bar 330 may be identical to the end cap 340 on the other end of the tubular bar 330, or the two end caps 340 may have a somewhat different design or shape. A flange-like lip 346 may be included on the end caps 340, where the lip 346 prevents the rope 350 from pinching the user's hand against the conical grip element 320, and the lip 346 also prevents the grip element 320 from moving axially along the tubular bar 330. In various embodiments, the lip 346 may be larger than shown in FIG. 4, or smaller, or not used at all, and may be the same on both end caps 340 or different on the two end caps 340.

The tubular bar 330 is constructed of any suitably rigid material—including metals such as steel or aluminum, or structural thermoplastics or composites. Preferred embodiments include making the tubular bar 330 from metal tubing suitable for forming screw threads on interior surfaces at both ends, or from metal tubing suitable for allowing a press fit of the ends caps 340 into the ends of the tubular bar 330.

The end caps 340 may also be constructed of any suitably rigid material—including metals such as steel or aluminum, or structural thermoplastics or composites. Preferred embodiments include casting or machining the end caps 340 from aluminum, suitable for forming screw threads on exterior surfaces of the end caps 340 to be threaded into the ends of the tubular bar 330, or suitable for allowing a press fit of the ends caps 340 into the ends of the tubular bar 330. Another embodiment is envisioned where both the tubular bar 330 and the end caps 340 are made of rigid plastic or a composite possibly including carbon fiber, and the end caps 340 are glued into the tubular bar 330 for assembly.

Figure 5:
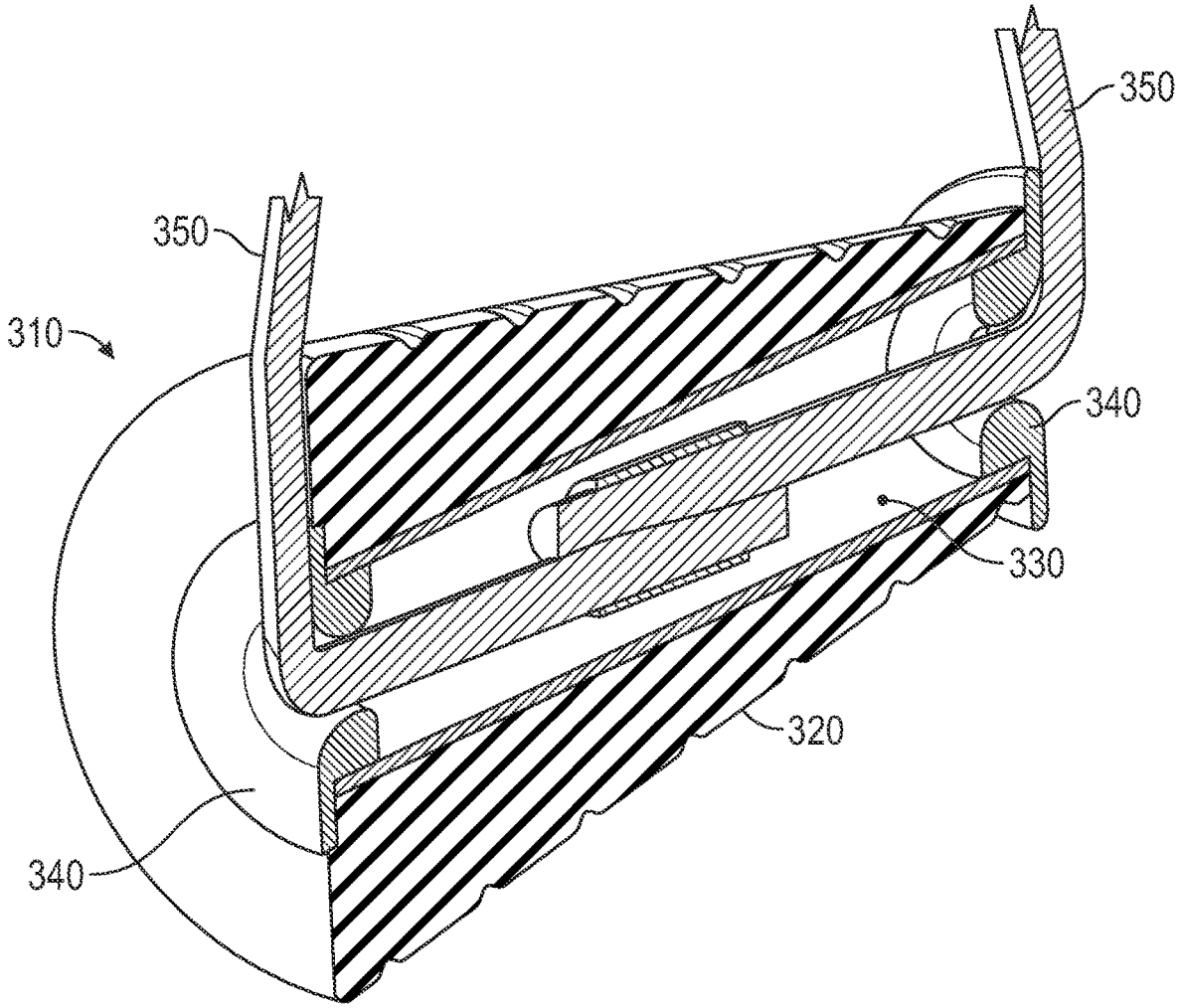
FIG. 5 is a cross-sectional illustration of the grip assembly with the conical grip element, the tubular bar and end caps as shown in FIG. 4, also showing ends of the rope secured inside the tubular bar, according to an embodiment of the present disclosure.

FIG. 5 is a cross-sectional illustration of the conical grip element 320 with the tubular bar 330 and the end caps 340 as shown in FIG. 4, also showing ends of the rope 350 secured inside the tubular bar 330, according to an embodiment of the present disclosure. The rope 350 is a piece of rope or other tensile material (e.g., flat strap or webbing, shown in a later figure) having a length of about 30", where about 24" of the rope 350 forms the continuous loop outside of the grip assembly 310 (refer also to FIG. 3), and about 6" of the rope 350 is located inside of the tubular bar 330. The two ends of the rope 350 are secured inside of the tubular bar 330, in one of various manners discussed below with respect to FIG. 6. The portion of the rope 350 which forms the continuous loop outside of the grip assembly 310 may be longer or shorter than 24", without affecting the function or utility of the gym handle 300. The total length of the rope 350 may also be adjusted, more or less than 30", depending on which of the techniques of securing the ends inside the tubular bar 330 is used.

The grip assembly 310 is shown in an assembled configuration in FIG. 5, where the conical grip element 320 is fitted over the tubular bar 330, and the end caps 340 are installed in the ends of the tubular bar 330. FIG. 5 also shows the ends of the rope 350 secured inside the tubular bar 330 by crimping with a ferrule, which is a preferred embodiment because it is consistently repeatable in a manufacturing operation, thus providing finished products where every gym handle has precisely the same length of the rope 350 forming the continuous loop outside of the grip assembly 310.

Figure 6A:
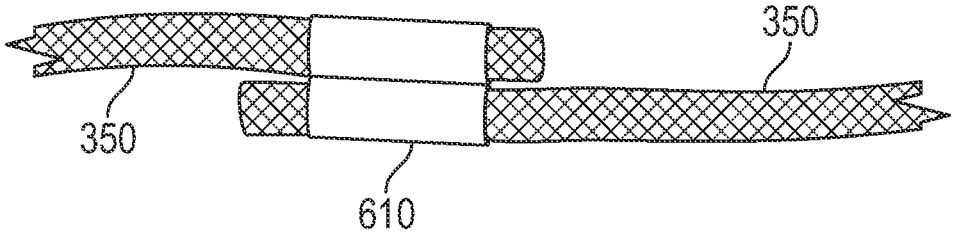
FIGS. 6A, 6B and 6C are illustrations of different techniques of securing the ends of the rope inside the tubular bar, according to embodiments of the present disclosure.
Figure 6B:
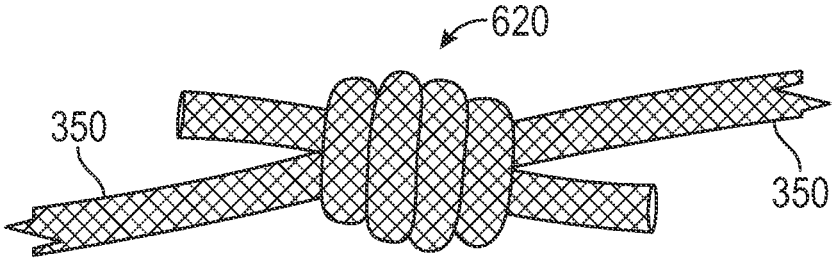
Figure 6C:
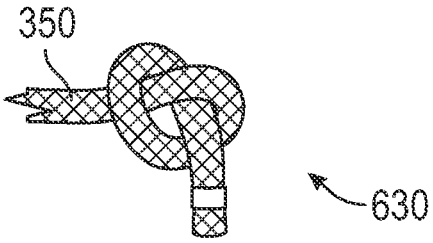

FIGS. 6A, 6B and 6C are illustrations of different techniques of securing the ends of the rope 350 inside the tubular bar 330 of FIG. 5, according to embodiments of the present disclosure. In FIG. 6A, a crimping ferrule 610 is used to crimp together the two ends of the rope 350, in the manner shown in FIG. 5. The crimping operation takes place outside of the tubular bar 330, as described below, so physical space for a crimping tool is not an issue. In another embodiment shown in FIG. 6B, a rope-to-rope knot 620 is used to fasten together the two ends of the rope 350. A double fisherman's knot is illustrated in FIG. 6B, but any line-to-line knot with suitable size and strength may be used for the rope-to-rope knot 620. In another embodiment shown in FIG. 6C, a line-end or stopper knot 630 is tied in each end of the rope 350. In this embodiment, the two ends of the rope 350 are not fastened together, but rather the stopper knot 630 is large enough to prevent the ends of the rope 350 from passing through the aperture 342 of the end caps 340.

Figure 7A:
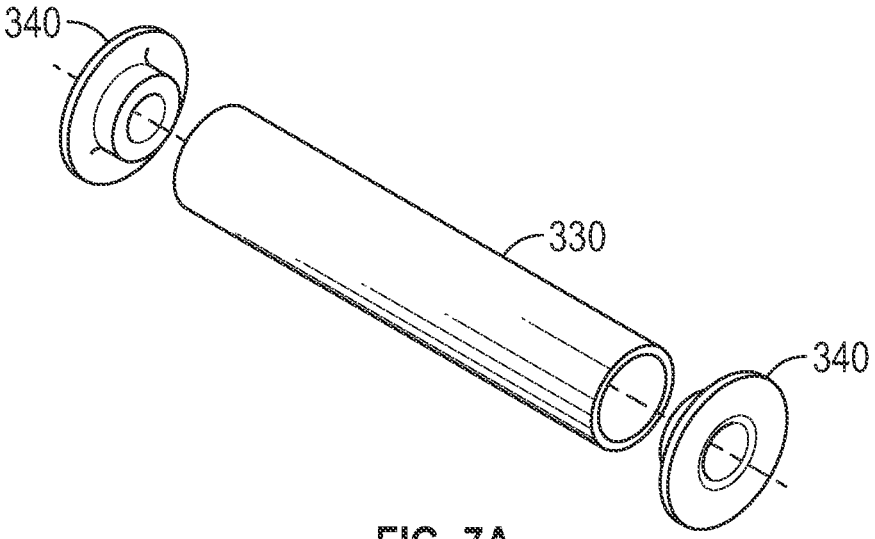
FIGS. 7A and 7B are exploded-view and conventional illustrations, respectively, of the tubular bar and end caps shown in FIGS. 4 and 5, according to embodiments of the present disclosure.
Figure 7B:
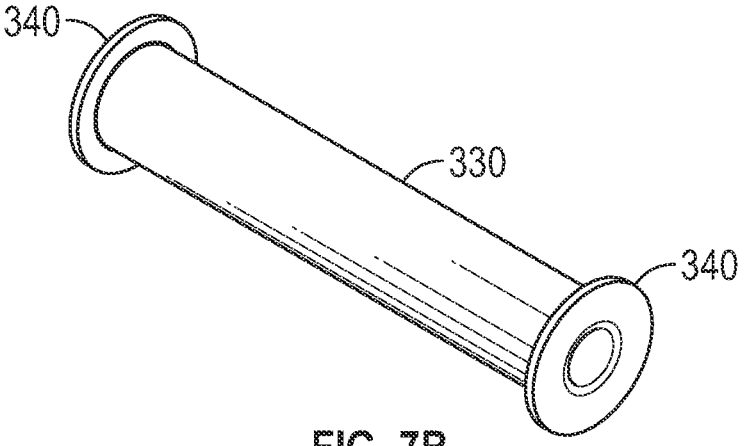

FIGS. 7A and 7B are exploded-view and conventional illustrations, respectively, of the tubular bar 330 and the end caps 340 shown in FIGS. 4 and 5, according to embodiments of the present disclosure. FIG. 7A shows the end caps 340 positioned opposite the ends of the tubular bar 330, as the components would be positioned before assembly. The end caps 340 may be fixedly installed into the ends of the tubular bar 330 in any suitable manner—such as by screwing in when both the end caps exterior and the tubular bar interior are threaded, by press fit of the end caps 340 into the tubular bar 330, or by cementing the end caps 340 into the tubular bar 330 using an adhesive. FIG. 7B shows the tubular bar 330 and the end caps 340 in an assembled configuration. The conical grip element 320, not shown in FIGS. 7A and 7B, would be installed over the tubular bar 330 before installation of the end caps 340. Referring to FIGS. 5-7, methods of assembling the gym handle 300 are discussed below.

In a preferred embodiment of an assembly method for the gym handle 300, the conical grip element 320 is first pressed onto the tubular bar 330, such that the tubular bar 330 fits snugly (friction fit) inside the central cylindrical hole in the grip element 320. The end caps 340 are then slipped over the two ends of the rope 350, where the end caps 340 are oriented so as to later be installed into the tubular bar 330. One end of the rope 350 is then passed into one end of the tubular bar 330 and all the way through the tubular bar 330 and out the opposite end. The two ends of the rope 350 are now proximal, outside the tubular bar 330, and may be fastened together using the crimping ferrule 610 or the rope-to-rope knot 620. Alternately, the stopper knot 630 may be tied in each end of the rope 350. The ends of the rope 350 are then drawn back inside the tubular bar 330, and the end caps 340 are fitted into the ends of the tubular bar 330—such as by threading, press fit, or using an adhesive. A slightly different assembly sequence may easily be envisioned, such as installing one of the end caps 340 into an end of the tubular bar 330 immediately before or immediately after pressing the conical grip element 320 onto the tubular bar 330.

Figure 8:
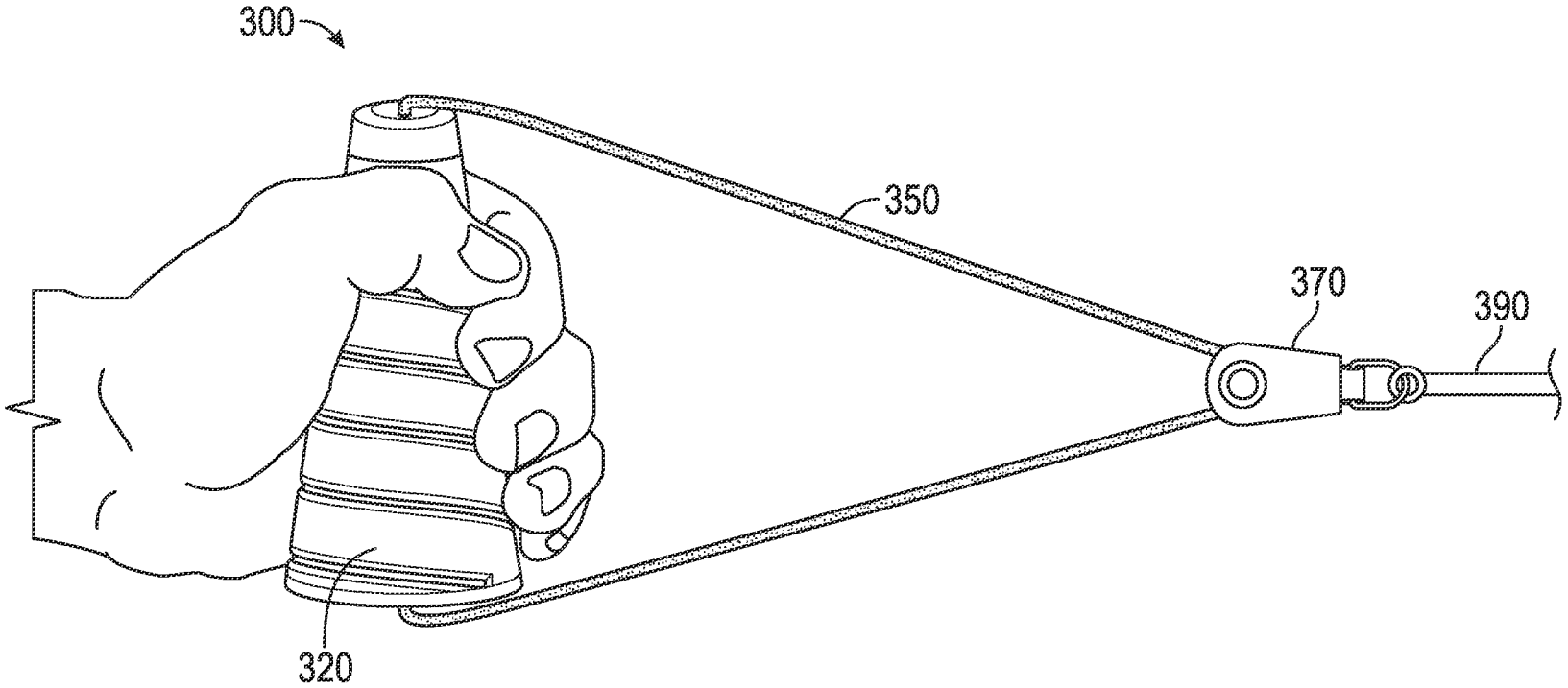
FIG. 8 is an illustration of the gym handle having the conical grip element in the hand of a user, with the rope coupled to a cable or resistance band of an exercise equipment apparatus, according to an embodiment of the present disclosure.

FIG. 8 is an illustration of the gym handle 300 having the conical grip element 320 in the hand of a user, and with the rope 350 coupled to a cable or resistance band 390 of an exercise equipment apparatus, according to an embodiment of the present disclosure. The disclosed gym handle 300 with a conical grip represents an improvement over existing designs. As apparent in FIG. 8, the user's hand is in a comfortable position when grasping the conical grip element 320.

In addition to the embodiments shown in FIGS. 4-8—with the conical grip fitted over a tubular bar, and end caps on the tubular bar—other construction embodiments are also envisioned. These are shown in the following figures and discussed below.

Figure 9:
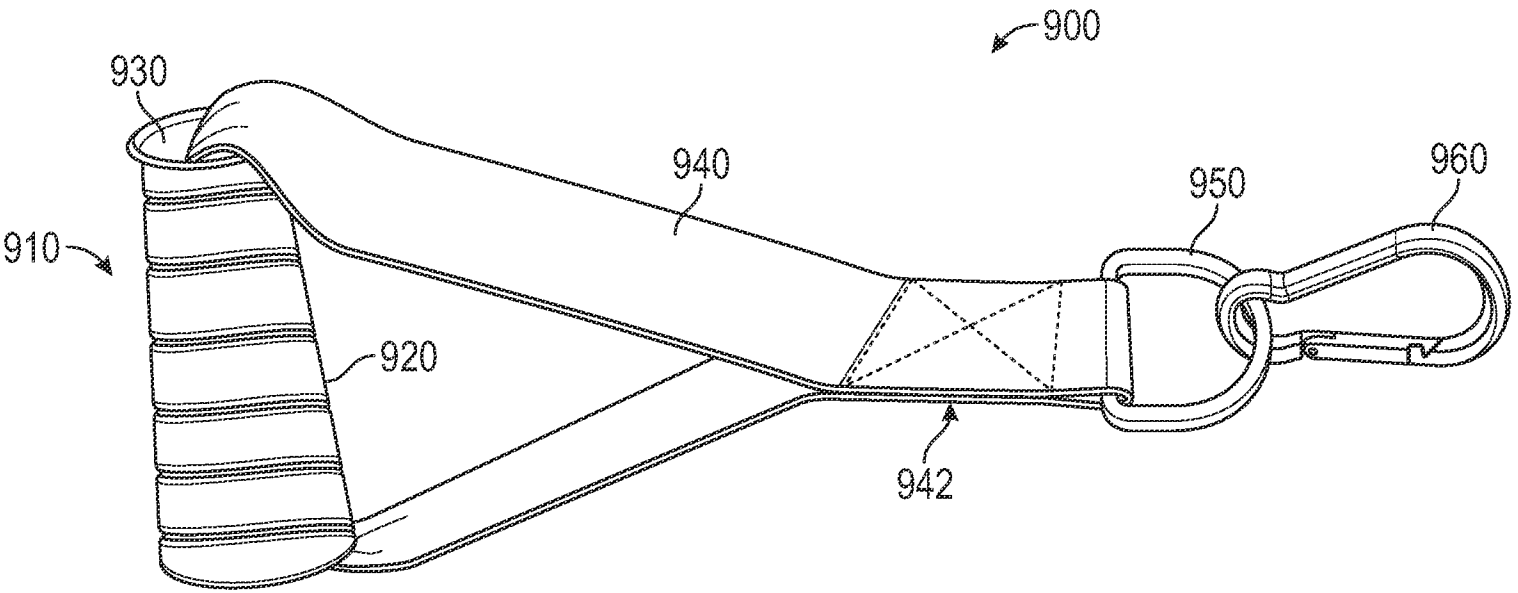
FIG. 9 is an illustration of another design embodiment of a gym handle having a conical grip element, where a flat strap or webbing replaces the rope of FIG. 8 and the tubular bar has a different design with no end caps, according to an embodiment of the present disclosure.

FIG. 9 is an illustration of a gym handle 900—which is another design embodiment of a gym handle having a conical grip element, where a flat strap or webbing replaces the rope of earlier figures, and the tubular bar has a different design with no end caps, according to an embodiment of the present disclosure. The gym handle 900 provides all of the benefits of the gym handle 800 discussed above, but with a different construction.

A grip assembly 910 comprises a conical grip element 920 fitted over a tubular bar 930. The conical grip element 920 is substantially the same as the conical grip element 320 discussed at length earlier—including shape, dimensions, materials, surface pattern, etc. The tubular bar 930 is positioned inside a central cylindrical opening in the conical grip element 920, where the conical grip element 920 may be directly over-molded on the tubular bar 930, or the conical grip element 920 may be pressed onto the tubular bar 930. The tubular bar 930 provides rigidity (bending resistance) to the grip assembly 910, but has a different design than the tubular bar 330 discussed earlier. The tubular bar 930 is shown in FIG. 10 and discussed further below.

In the gym handle 900, a strap element 940 is used as a tensile member, replacing the rope of FIGS. 3-8. The strap element 940 is preferably a flat webbing, woven of a material such as nylon. Key characteristics of the strap element 940 are flexibility and tensile strength, along with resistance to tearing or wearing. In a preferred embodiment, ends of the strap element 940 are attached together in any suitable manner (such as by sewing) inside or outside the tubular bar 930, and the remainder of the strap element 940 forms a continuous loop outside the tubular bar 930. A portion of opposing sides of the strap element 940 are secured together—such as by sewing—at a fixed section 942 located on the strap element 940 opposite and distal from the grip assembly 910. The fixed section 942 provides shape conformity to the strap element 940 and the gym handle 900, and creates a small fixed loop of the strap element 940. A ring-like device such as a D-ring 950 is fitted inside the small fixed loop in the end of the strap element 940 distal from the grip assembly 910, where the D-ring 950 (or other ring-like device) is captured in the end loop by the fixed section 942 as shown. A coupling element 960 couples the D-ring 950 (or other ring-like device) of the gym handle 900 to the exercise equipment, where the coupling element 960 may be any suitable connecting device such as a ring, a quick connect link, a snap hook or a carabiner. In some embodiments, the D-ring 950 or the coupling element 960 is an eye-to-eye swivel which allows rotation of the gym handle 900 without twisting the cable which leads to the exercise equipment.

Figure 10:
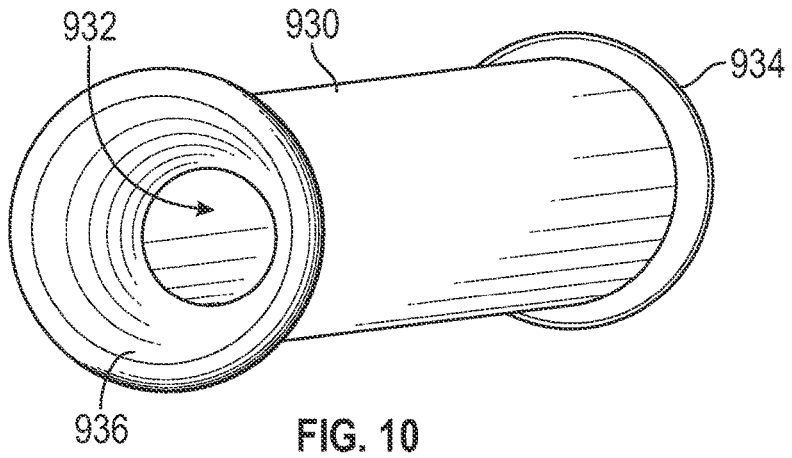
FIG. 10 is an illustration of the tubular bar used in the gym handle of FIG. 9, according to an embodiment of the present disclosure.

FIG. 10 is an illustration of the tubular bar 930 used in the gym handle 900 of FIG. 9, according to an embodiment of the present disclosure. The tubular bar 930 has a cylindrical outer surface and a central cylindrical hole 932, similar to the tubular bar 330 described earlier. However, the tubular bar 930 is not designed to accept end caps. Instead, the tubular bar 930 has flange-like ends 934 which may prevent axial movement of the conical grip element 920 relative to the tubular bar 930, and inner surfaces 936 (at both ends) which are curved to provide a smooth guide surface for the strap element 940 where it exits the tubular bar 930.

The tubular bar 930 may be constructed of any suitable lightweight and rigid material—such as plastic, composite or aluminum. In a preferred embodiment, the tubular bar 930 is formed as a single piece, where a molded plastic piece is most preferred. The gym handle 900 may be assembled by placing the D-ring 950 over one end of the strap element 940 and positioning the D-ring 950 at approximately mid-length of the strap element 940, forming the fixed section 942 such as by sewing, thus constraining the D-ring 950 in the small end loop of strap material, passing one free end of the strap element 940 through the grip assembly 910, and attaching the two free ends of the strap element 940 such as by sewing. The sewn-together end of the strap element 940 can then be moved back inside the grip assembly 910, resulting in the assembled gym handle 900 as shown in FIG. 9.

Figure 11:
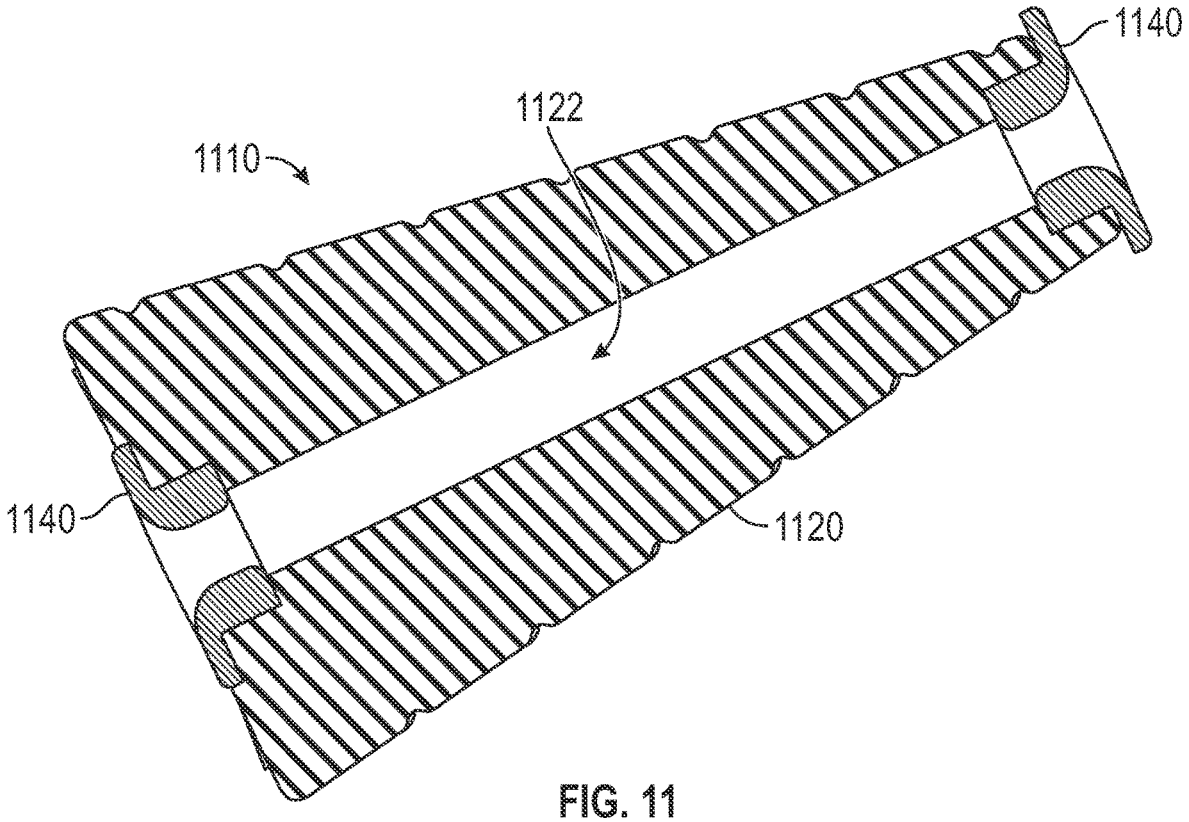
FIG. 11 is a cross-sectional illustration of another design embodiment of a grip assembly, where no tubular bar is used in the cylindrical hole in the conical grip element, and end caps are fitted directly into the conical grip element at each end, according to an embodiment of the present disclosure.

FIG. 11 is a cross-sectional illustration of a grip assembly 1110, which is another design embodiment of a grip assembly for a gym handle, where no tubular bar is used, according to an embodiment of the present disclosure. The grip assembly 1110 includes a conical grip element 1120 which has a wall thickness and/or a construction material which provide enough rigidity that the conical grip element 1120 will not bend under load, even without the reinforcement of a tubular bar.

The conical grip element 1120 is molded or formed as a single piece, and has a central cylindrical hole 1122. End caps 1140 may be provided, which have a similar design and features as the end caps 340 discussed earlier. However, because there is no tubular bar, the end caps 1140 are fitted directly into the ends of the conical grip element 1120. The end caps 1140 may be press-fit, glued or screwed into the ends of the conical grip element 1120.

The conical grip element 1120 may be constructed of a composite stabilized rubber (which adds some rigidity) or a harder rubber or other material, so that it is stiff enough not to bend under load. With some grip element materials, no end caps are needed, and the central cylindrical hole 1122 has inner facing surfaces on both ends which are convexly curved for smooth interface with the flexible tensile member. The conical grip element 1120 may be used with a rope as a flexible tensile member (as in FIGS. 3 and 8), or with a strap as a flexible tensile member (as in FIG. 9). The sizes of the central cylindrical hole 1122 and the end caps 1140 may be selected to be suitable for whichever tensile member is used—whether a rope or a strap.

The conical grip element in the various embodiments of the present disclosure has an ergonomic shape designed to match the natural anatomical shape of the user's hand, providing a secure grasp without requiring the user to apply a very tight grasp pressure. The ergonomic grip shape also reduces fatigue in the user's hand, making the grasping more comfortable. Additionally, in the disclosed gym handles, the grip force is distributed across a larger surface area of the user's hand compared to the grip shown in FIG. 2, and the unique shape and material of the disclosed gym handle keeps the user's hand from sliding off the grip. Thus, the gym handles of the present disclosure require less grip strength for a given amount of exercise cable tension, thus making the disclosed gym handles a prime candidate for use in rehabilitation exercise devices, or by any person seeking more grasp comfort and less grasp fatigue when performing tension cable/band type exercises.

The foregoing discussion discloses and describes merely exemplary embodiments of the present disclosure. One skilled in the art will readily recognize from such discussion and from the accompanying drawings and claims that various changes, modifications and variations can be made therein without departing from the spirit and scope of the disclosure as defined in the following claims.

What is claimed is:

1. A gym handle for coupling a user's grasp to an exercise apparatus, said gym handle comprising:

a conical grip element having first and second ends, a central cylindrical hole and a cone-shaped exterior, the conical grip element has a surface with a spiral-shaped groove traversing the cone-shaped exterior continuously from the first end to the second end of the conical grip element;

a flexible tensile member with each end passing inwardly through one of the ends of the conical grip element and terminating inside the central cylindrical hole, where the flexible tensile member forms a continuous loop outside the conical grip element; and a coupling device configured for coupling the flexible tensile member to the exercise apparatus.

2. The gym handle according to claim 1 wherein the conical grip element is constructed of a material selected from a group including natural or synthetic rubbers, foams, other elastomers, and cork.

3. The gym handle according to claim 2 wherein the material has a hardness in a range from Shore 20-00 to Shore 90A.

4. The gym handle according to claim 1 further comprising a tubular bar positioned in the central cylindrical hole of the conical grip element.

5. The gym handle according to claim 4 further comprising an end cap fitted into each end of the tubular bar, the end caps having a central aperture through which the ends of the flexible tensile member pass.

6. The gym handle according to claim 1 further comprising an end cap fitted into the first and second ends of the conical grip element, the end caps having a central aperture through which the ends of the flexible tensile member pass.

7. The gym handle according to claim 1 wherein the flexible tensile member is a rope or a flat strap of webbing material.

8. The gym handle according to claim 1 wherein the conical grip element has a length in a range from 4.0-6.5 inches.

9. The gym handle according to claim 1 wherein the conical grip element has an outside diameter at the first end in a range from 0.75-1.25 inches, and the outside diameter increases continuously along a length of the conical grip element from the first end to the second end.

10. The gym handle according to claim 1 wherein the cone-shaped exterior of the conical grip element has a cone angle in a range from 10°-35°.

11. A gym handle for coupling a user's grasp to an exercise apparatus, said gym handle comprising:

a tubular bar having first and second ends;

a conical grip element having first and second ends, a central cylindrical hole and a cone-shaped exterior, where the tubular bar is positioned in the central cylindrical hole of the conical grip;

an end cap fitted into each end of the tubular bar, the end caps having a central aperture opening to the central cylindrical hole; and a flexible tensile member passing through the end caps and the tubular bar, opposing ends of the tensile member being coupled together at a location inside the tubular bar, the coupled ends of the tensile member being slidable within the tubular bar and constrained from exiting the tubular bar by the end caps, where the flexible tensile member forms a continuous loop outside the tubular bar.

12. The gym handle according to claim 11 wherein the conical grip element is constructed of a material selected from a group including natural or synthetic rubbers, foams, cork and other elastomers.

13. The gym handle according to claim 12 wherein the material has a hardness in a range from Shore 20-00 to Shore 90A.

14. The gym handle according to claim 12 wherein the material has an exterior surface which is tacky to the touch.

15. The gym handle according to claim 11 wherein the tubular bar and the conical grip element have a length in a range from 4.0-6.5 inches.

16. The gym handle according to claim 11 wherein the conical grip element has an outside diameter at the first end in a range from 0.75-1.25 inches, and the outside diameter increases continuously along a length of the conical grip element from the first end to the second end.

17. The gym handle according to claim 11 wherein the cone-shaped exterior of the conical grip element has a cone angle in a range from 10°-35°.

18. The gym handle according to claim 11 wherein the conical grip element has a surface with a spiral-shaped groove traversing the cone-shaped exterior continuously from the first end to the second end of the conical grip element.

19. The gym handle according to claim 11 wherein the end caps are screwed into the ends of the tubular bar, where screw threads on an exterior surface of each end cap engage screw threads on an interior surface of the tubular bar.

20. The gym handle according to claim 11 wherein the end caps are fitted into the ends of the tubular bar by press-fit or by using an adhesive.

21. The gym handle according to claim 11 wherein the end caps include a flange with an outer diameter larger than an outer diameter of the tubular bar.

22. The gym handle according to claim 11 wherein the central aperture of the end caps has a convexly curved inner surface facing the flexible tensile member.

23. The gym handle according to claim 11 wherein the flexible tensile member is a rope, and the ends of the rope are fastened together inside the tubular bar by crimping with a ferrule or by tying in a knot, where the ferrule or the knot is larger than the central aperture of the end caps.

24. The gym handle according to claim 11 further comprising a coupling device configured for coupling the continuous loop of the flexible tensile member to the exercise apparatus, where the coupling device is a ring, an eye-to-eye swivel, a carabiner, a threaded quick-link or a pulley with an attachment hole or eye loop.

25. A gym handle for coupling a user's grasp to an exercise apparatus, said gym handle comprising:

a tubular bar having first and second ends;

a conical grip element having first and second ends, a central cylindrical hole and a cone-shaped exterior, the conical grip element having a surface with a spiral-shaped groove traversing the cone-shaped exterior continuously from the first end to the second end, where the tubular bar is positioned in the central cylindrical hole of the conical grip;

a flexible tensile member passing through the tubular bar and forming a continuous loop outside the tubular bar; and a connector element used to couple the gym handle to the exercise apparatus.

26. The gym handle according to claim 25 wherein the conical grip element is constructed of a material selected from a group including natural or synthetic rubbers, foams, cork and other elastomers.

27. The gym handle according to claim 26 wherein the material has a hardness in a range from Shore 20-00 to Shore 90A.

28. The gym handle according to claim 25 wherein the flexible tensile member is a strap element made of a flat webbing material, where one end of the strap element is fastened to another portion of the strap element to form the continuous loop.

29. The gym handle according to claim 28 wherein opposing sections of the strap element are fastened together to form a fixed loop at a position of the strap element opposite the conical grip element, and the connector element with a section positioned inside the fixed loop, and where the connector element is selected from a group including a ring, an eye-to-eye swivel, a pulley, a carabiner, a quick connect link, and a D-ring.

30. The gym handle according to claim 25 wherein the tubular bar and the conical grip element have a length in a range from 4.0-6.5 inches.

31. The gym handle according to claim 25 wherein the conical grip element has an outside diameter at the first end in a range from 0.75-1.25 inches, and the outside diameter increases continuously along a length of the conical grip element from the first end to the second end.

32. The gym handle according to claim 25 wherein the cone-shaped exterior of the conical grip element has a cone angle in a range from 10°-35°.

33. The gym handle according to claim 25 wherein the tubular bar is formed with a flange at each of the ends, said flanges having an outer diameter larger than an inner diameter of the central cylindrical hole in the conical grip element.

34. The gym handle according to claim 25 wherein each of the ends of the tubular bar is formed with a convexly curved inner surface facing the flexible tensile member.

* * * * *